US011623155B1

(12) United States Patent
Gilmartin

(10) Patent No.: US 11,623,155 B1
(45) Date of Patent: Apr. 11, 2023

(54) SWING SEAT ASSEMBLY

(71) Applicant: Brian Gilmartin, Cloverdale, IN (US)

(72) Inventor: Brian Gilmartin, Cloverdale, IN (US)

( * ) Notice: Subject to any disclaimer, the term of this patent is extended or adjusted under 35 U.S.C. 154(b) by 0 days.

(21) Appl. No.: 17/498,791

(22) Filed: Oct. 12, 2021

(51) Int. Cl.
*A63G 9/12* (2006.01)
*A63G 9/02* (2006.01)

(52) U.S. Cl.
CPC *A63G 9/12* (2013.01); *A63G 9/02* (2013.01)

(58) Field of Classification Search
CPC ... A63G 9/00; A63G 9/02; A63G 9/12; A63G 9/16
USPC ..... 472/118, 125; 297/245
See application file for complete search history.

(56) References Cited

U.S. PATENT DOCUMENTS 3,466,033 A * 9/1969 Pori ..... A63G 9/00 472/14
7,951,012 B1 * 5/2011 Burriss ..... A63G 1/14 472/125

* cited by examiner

*Primary Examiner* — Kien T Nguyen
(74) *Attorney, Agent, or Firm* — C. John Brannon; Brannon Sowers & Cracraft PC

(57) ABSTRACT

A swing seat assembly, including a seat portion and a support portion, a lower support bar and an upper support bar, a lower set of elongate cables having first ends coupled with the lower support bar and second ends coupled with the seat portion, and an upper set of elongate cables having first ends coupled with a stationary support structure and second ends coupled with the upper support bar. The lower support bar is rotatably coupled with the upper support bar.

7 Claims, 6 Drawing Sheets

SWING SEAT ASSEMBLY

The present disclosure relates to a support portion of a swing seat assembly. More specifically, the present disclosure relates to a support portion permitting rotation of a swing relative to a stationary support structure.

SUMMARY

The present disclosure relates to a support portion of a swing seat assembly. More specifically, the present disclosure relates to a support portion permitting rotation of a swing relative to a stationary support structure.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like element.

DETAILED DESCRIPTION

Before the present methods, implementations, and systems are disclosed and described, it is to be understood that this invention is not limited to specific synthetic methods, specific components, implementation, or to particular compositions, and as such may, of course, vary. It is also to be understood that the terminology used herein is for the purpose of describing particular implementations only and is not intended to be limiting.

Figure 1:
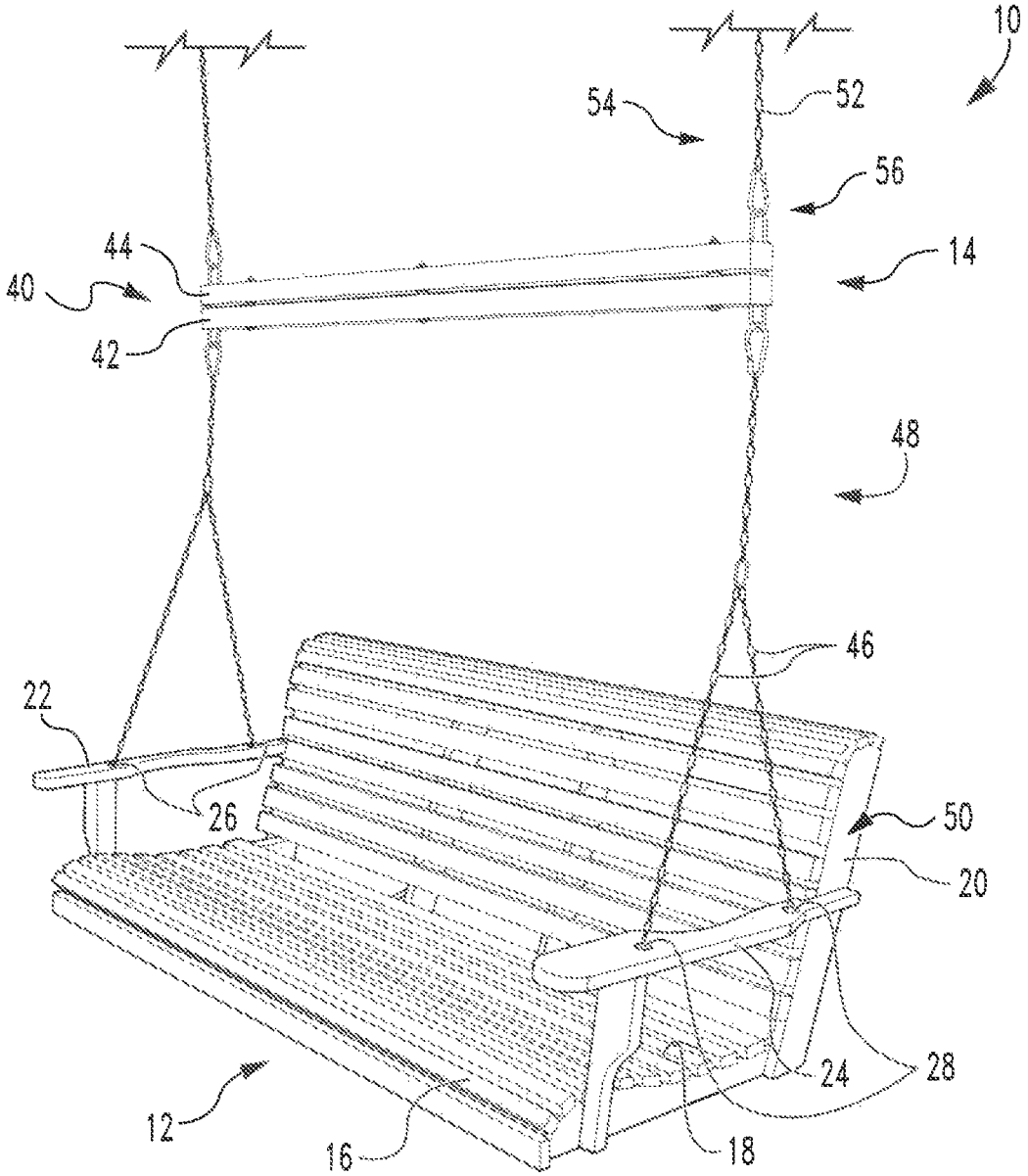
FIG. 1 depicts an exemplary embodiment of a swing seat assembly, according to the present disclosure.

FIG. 1 depicts an exemplary swing seat assembly, according to the present disclosure. The swing seat assembly 10 includes a seat portion 12 and a support portion 14.

The seat portion 12 includes a seat 16, such as a bench seat, which may accommodate one, two, or three people. The seat 16 may include both a lower support 18 and a back support 20 to support people occupying the seat 16. As shown, the seat 16 may also include armrests 22, 24 on opposing sides of the seat 16. The armrests 22, 24 may include hardware 26, 28 or the like for coupling the seat portion 12 and the support portion 14. These couplings may be facilitated using various hardware 26, 28 to join the disclosed components. It should be appreciated that any of the components of the swing seat assembly 10 may be made from any of a plurality of materials, such as, for example, wood, plastic, metal, etc., or combinations thereof.

The support portion 12 includes a pair of support bars 40. For example, and as shown, the pair of support bars 40 may include a lower support bar 42 and an upper support bar 44. Each of the lower and upper support bars 42, 44 may be solid or hollow and may have any of a variety of different cross-sections. Dimensions and other specificities may vary depending on the specific implementation. A lower set of elongate cables 46, which may be made from any material, including traditional chain link, have first ends 48 coupled with the lower support bar 42 and second ends 50 coupled with the seat 16. An upper set of elongate cables 52 have first ends 54 coupled with a stationary support structure 58 (as shown in FIG. 2) and second ends 56 coupled with the upper support bar 44.

As will be described below, the lower support bar 42 is rotatably coupled with the upper support bar 44. The lower set of elongate cables 46 and the upper set of elongate cables 52 may have different flexibility and tensile strength, for example, which may vary based on the application.

Figure 2:
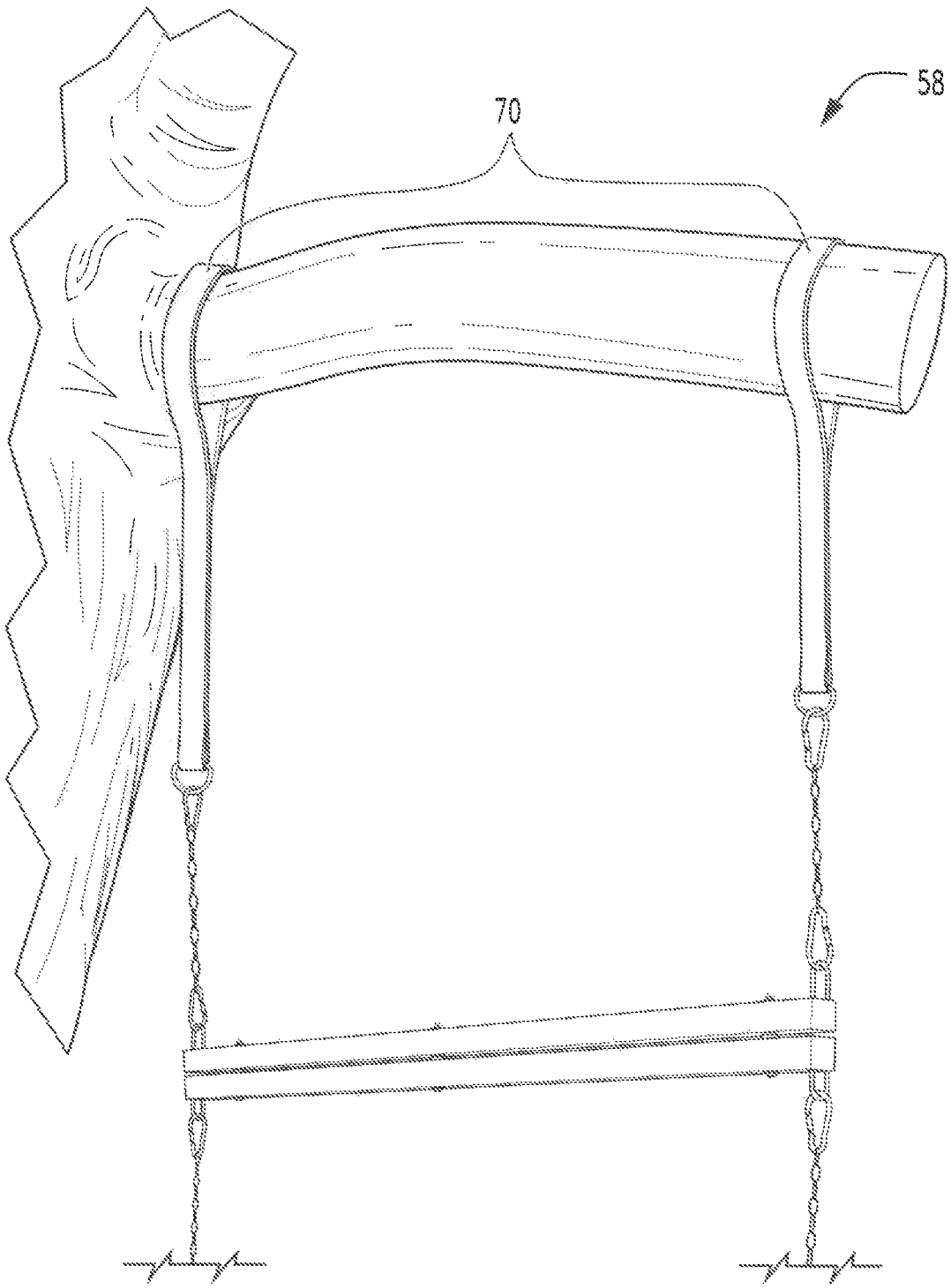
FIG. 2 depicts a stationary support structure configured to support a swing seat, according to the present disclosure.

FIG. 2 depicts a stationary support structure 58 configured to support a seat 12. The stationary support structure may include trees, houses, freestanding frames, etc. As shown, straps 70, such as bungee straps, that may be suspended from a tree branch, may be used to support the seat portion 12. According to the exemplary embodiment, the upper set of elongate cables 52 may connect the straps 70 with the upper support bar 44. Thus, the upper support bar 44 may remain stationary relative to the stationary support structure 58.

Figure 3:
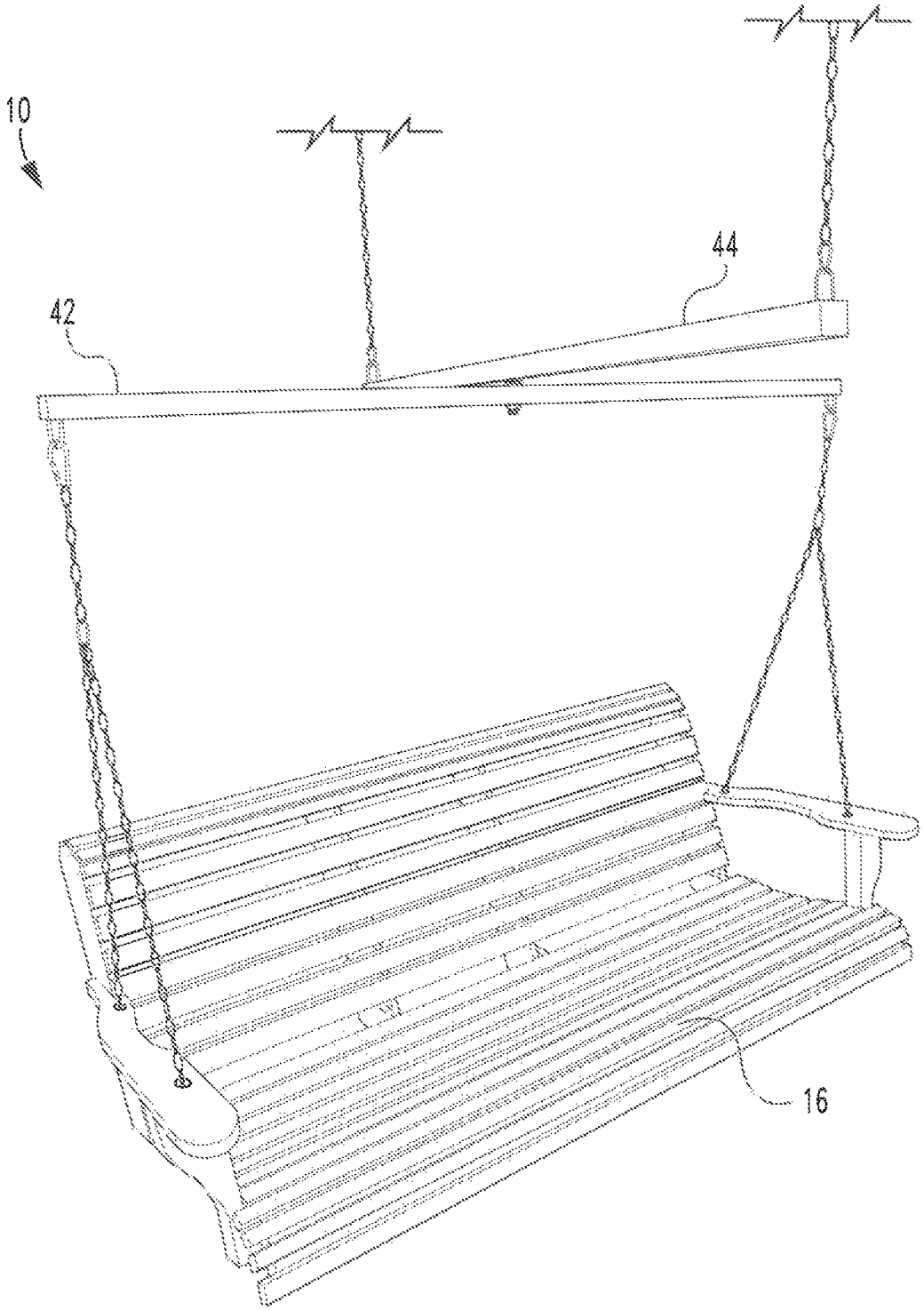
FIG. 3 depicts the exemplary swing seat assembly in a rotated position, according to the present disclosure.

FIG. 3 depicts the exemplary swing seat assembly 10 in a rotating position, according to the present disclosure. In particular, the lower support bar 42 is rotatably coupled to the upper support bar 44. As such, the seat 16 rotates with the lower support bar 42, relative to the upper support bar 44. According to the exemplary embodiment, the seat 16 may rotate 180 degrees and, thus, permit opposite orientations of the seat 16. The seat 16 may be permitted to rotate between the opposite orientations.

Figure 4:
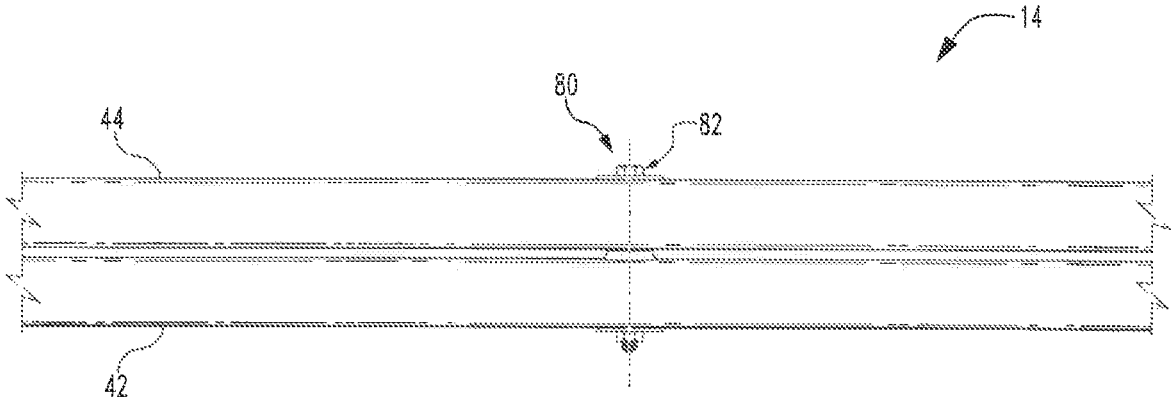
FIG. 4 depicts upper and lower support bars of a support portion of the swing seat assembly, showing the center rotatable pivot, according to the present disclosure.

FIG. 4 depicts lower and upper support bars 42, 44 of a support portion 14 of the swing seat assembly 10. As stated above, the lower support bar 42 is permitted to rotate relative to the upper support bar 44. According to the present disclosure, a bolt assembly 80, such as a shoulder bolt assembly, may couple the lower support bar 42 and the upper support bar 44 at a joint 82 while also permitting the repositioning, or rotation, of the lower support bar 42 relative to the upper support bar 44.

Figure 5:
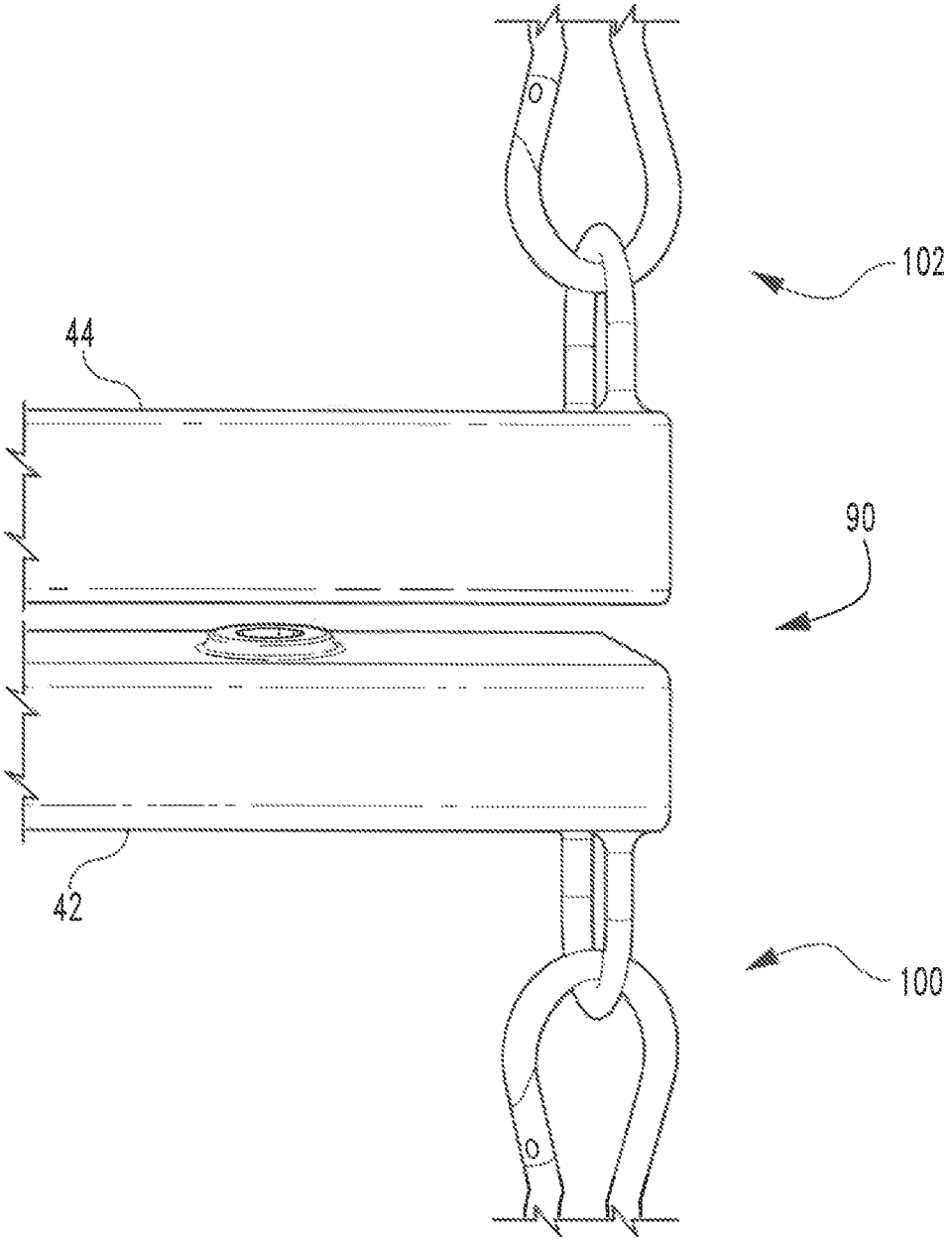
FIG. 5 depicts a portion of the upper and lower support bars at ends thereof, ready for rotation, according to the present disclosure.
Figure 6:
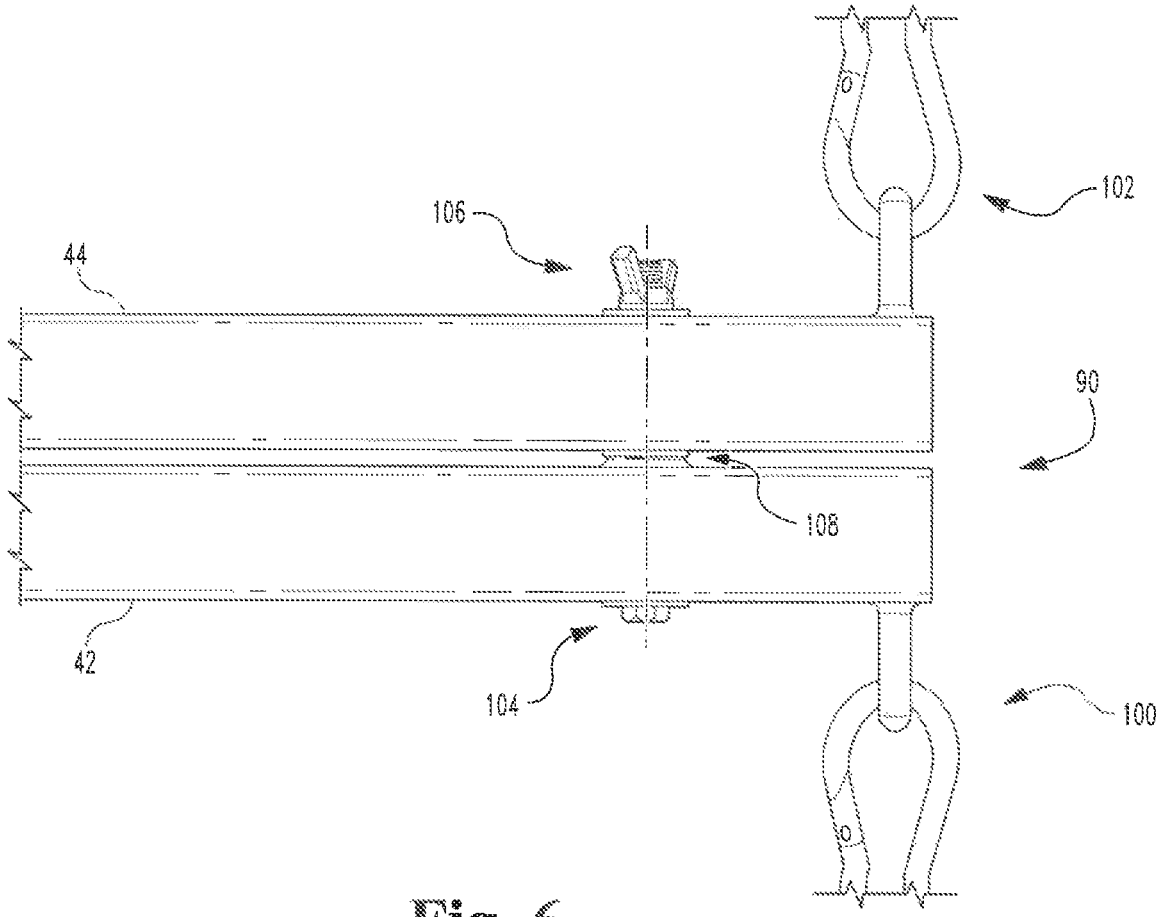
FIG. 6 depicts another feature of the upper and lower support bars at ends thereof, in a stabilized position, according to the present disclosure.

FIG. 5 depicts a portion of the lower and upper support bars 42, 44 at an end 90 thereof. As shown, the lower support bar 42 is coupled to the seat 16 using the lower set of elongate cables 46 and the upper support bar 44 is suspended by the stationary support structure 58. The lower support bar 42 includes a coupling feature 100 for attaching to the lower set of elongate cables 46. The upper support bar 44 includes a coupling feature 102 for attaching to the upper set of elongate cables 52.

As shown in FIG. 5, the present disclosure may provide a means for coupling the upper support bar 44 and the lower support bar 42, at the ends 90 thereof (and at the opposing ends thereof). For example, a bolt 104 may pass through openings of the upper support bar 44 and the lower support bar 42 to restrict movement of the upper support bar 44 and the lower support bar 42 relative to the other. A nut, or other securing component, 106 may secure the positioning of the bolt 104, and a washer or similar structure 108 may be used to keep the bolt 104 and nut 106 from loosening.

The bolt 104 may restrict the rotational movement of the upper and lower support bars 44, 42 and, thus, restrict rotational reorientation of the swing seat 16. The configuration shown in FIG. 5 may represent a first secured position of the swing seat assembly 10. As should be appreciated, with the bolt 104 removed, the upper and lower support bars 44, 42 may be free to rotate. For example, one of the upper and lower support bars may be rotated 180° relative to the other. This may provide a second secured position by using a bolt assembly or other similar fastening feature.

What is claimed is:

1. A swing seat assembly, including:

a bench seat portion; and a support portion;

a lower support bar and an upper support bar;

a lower set of elongate cables having first ends coupled with the lower support bar, at either end of the lower support bar, and second ends coupled with the bench seat portion, at either end of the bench seat portion;

an upper set of elongate cables having first ends coupled with a stationary support structure and second ends coupled with the upper support bar, at either end of the upper support bar;

wherein the lower support bar is rotatably coupled with the upper support bar;

wherein the lower support bar is rotatable relative to the upper support bar to rotate the bench seat portion between two fixed positions, wherein, in a first fixed position, the bench seat portion faces a first direction and, in a second fixed position, the bench seat portion faces an opposite direction;

and wherein a lock mechanism is positioned at each end of the lower support bar and the upper support bar to lock the first fixed position or the second fixed position.

2. The swing seat assembly of claim 1, further including a bolt assembly coupling the lower support bar and the upper support bar and permitting rotation of the lower support bar relative to the upper support bar.

3. The swing seat assembly of claim 1, wherein a bolt assembly couples the lower support bar and upper support bar at a center of each of the lower support bar and the upper support bar.

4. The swing seat assembly of claim 1, wherein the upper support bar and the lower support bar match with respect to shape and size.

5. The swing seat assembly of claim 1, wherein a first cable of the lower set of elongate cables and a first cable of the upper set of elongate cables are in vertical alignment, and a second cable of the lower set of elongate cables and a second cable of the upper set of elongate cables are in vertical alignment.

6. The swing assembly of claim 1, wherein, when the first fixed position or the second fixed position are locked, the lower support bar is prevented from rotating.

7. The swing assembly of claim 6, wherein, when the first fixed position or the second fixed position are locked, the bench swing portion is restricted to fore-aft movement.

* * * * *